United States Patent [19]

Lund

[11] 4,193,360

[45] Mar. 18, 1980

[54] KNIFE BLOCK ASSEMBLY TUFTING MACHINES

[75] Inventor: Ernest K. Lund, Accrington, England

[73] Assignee: Edgar Pickering (Blackburn) Limited, Lancashire, England

[21] Appl. No.: 963,579

[22] Filed: Nov. 24, 1978

[30] Foreign Application Priority Data

Jan. 9, 1978 [GB] United Kingdom ..... 759/78

[51] Int. Cl.[2] ..... D05C 15/00

[52] U.S. Cl. ..... 112/79 R

[58] Field of Search ..... 112/79 R, 79 A, 79.5, 112/79 FF

[56] References Cited

U.S. PATENT DOCUMENTS

| | | | |
|---|---|---|---|
| 3,440,983 | 4/1969 | Woodcock | 112/79 R |
| 3,788,245 | 1/1974 | Bonner | 112/79 R |
| 4,009,669 | 3/1977 | Wear | 112/79 R |
| 4,061,095 | 12/1977 | Price | 112/79 R |

*Primary Examiner*—Ronald Feldbaum

*Attorney, Agent, or Firm*—Watson, Cole, Grindle & Watson

[57] ABSTRACT

A knife block for use in a fine gauge tufting machine carries four knives, disposed in pairs on opposite sides of a central web with their edges engaged in opposed pairs of grooves in the block. The knives are retained in the block by two knurled cylindrical clamping blocks, which are disposed in slots in the block and are pressed by clamping screws into engagement with the edges of the knives.

2 Claims, 4 Drawing Figures

KNIFE BLOCK ASSEMBLY TUFTING MACHINES

In a tufting machine which produces cut pile fabric it is necessary for the knives, which cut the loops of yarn held by the loopers, to be inclined to the loopers at a small cutting angle which is normally of the order of 4°. The knives are accordingly presented to the loopers at this angle as viewed in plan. It is also necessary for the knives to be presented to the loopers, viewed in elevation, at another angle herein termed the pressing angle, which is normally of the order of 10°. As the knives contact and move across the loopers their top portions bend through this small angle as they flatten against the loopers to provide cutting pressure.

The knife assembly in a tufting machine may be constituted by a rectangular knife bar carrying a number of contiguous knife blocks, each of which carries a peg which engages a hole in the knife bar drilled at the cutting angle of about 4° to the perpendicular to the front face of the knife bar, each knife block carrying one or more knives and being so oriented with respect to the knife bar that the knives are inclined to the knife bar at the pressing angle of about 10°. A knife assembly of this construction is described in my U.S. Pat. No. 858027.

It is known to mount two knives in each knife block and to retain them in position by clamping screws which bear against portions of the block which have been weakened by slotting the block to press these portions of the block against the edges of the knives.

A modern requirement is a tufting machine in which the gauge (i.e. the distance between adjoining needles on the needle bar) is as fine as 1/16" and this means that such a conventional knife block would have a width of only ⅛", its peg would need to be of very small diameter and minute clamping screws would have to be used for retaining the knives in the block. Parts of such small dimensions are unable to withstand the stresses to which they are subjected in use.

The invention provides a knife block, for use in a fine gauge tufting machine and comprising front and rear members joined by a thinner central web, a peg projecting from the rear member for securing the knife block to a knife bar, four knives, which are disposed in pairs on opposite sides of the web and extend in planes parallel to the web with their edges accommodated in opposed pairs of slots in the front and rear members, two spaced, knurled cylindrical clamping blocks disposed in slots in the front member with their axes perpendicular to the planes of the knives and clamping screws, fitted into tapped holes in the front member, which press the clamping blocks into engagement with the edges of the knives.

Figure 1:
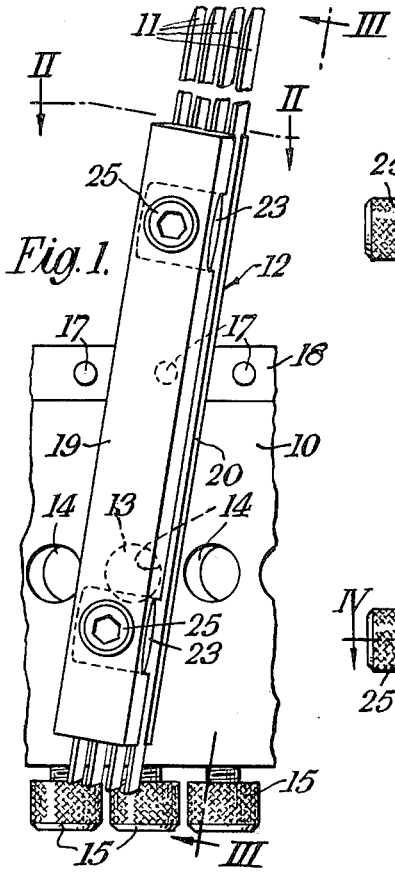
Figure 3:
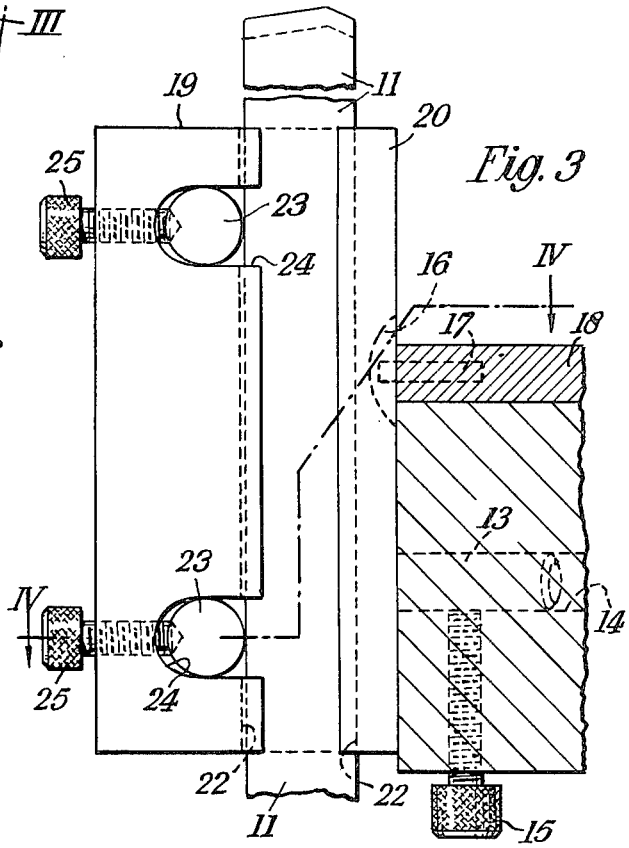
Figure 2:
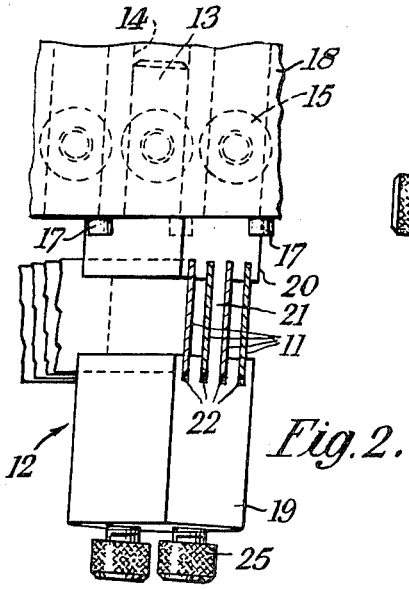
Figure 4:
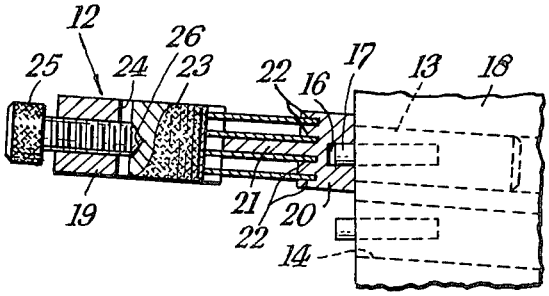

One embodiment of the invention will now be described in detail, by way of example, with reference to the accompanying drawing, in which:

FIG. 1 is a front elevation, showing part of a knife bar and a knife block according to the invention mounted thereon, FIG. 2 is a section on the line II—II in FIG. 1, FIG. 3 is a section on the line III—III in FIG. 2, and FIG. 4 is a section on the line IV—IV in FIG. 3.

The knife assembly shown in the drawings is, apart from the details of construction of the knife bars, generally similar to that described in U.S. application Ser. No. 858027.

As in the case of that Application, it includes a rectangular knife bar 10, to which oscillation is imparted in the well known manner, in use of the tufting machine to which the knife assembly is fitted, to cause knives 11 carried by the knife bar to cut loops of yarn held on the loopers of the machine.

The knives 11 are mounted in groups of four, as later described, on knife blocks 12 (one only of which is shown). Each knife block 12 carries a peg 13 and the pegs 13 are fitted into adjoining, equally spaced holes 14, which are drilled into the front face of the knife bar 10 at a small angle to the perpendicular, e.g. 4°, corresponding to the desired cutting angle as shown in FIG. 1. The pegs 13 are retained in the holes 14 by individual clamping screws 15. The knife blocks 12 are oriented to the knife bar 10, to cause the knives 11 to be presented to the loopers at the angle corresponding to the desired pressing angle, by engagement with slots 16 in their rear faces of individual pins 17 on a plate 18 attached to the top of the knife bar 10 as described in U.S. application Ser. No. 858027 pins 17 are spaced at the same pitch as the holes 14 and offset from the holes as shown in FIG. 1.

Each knife block 12 is constituted by a bar of generally rectangular shape and consisting of front and rear members 19, 20 of equal thickness joined by a thinner central web 21 as shown most clearly in FIG. 4. The members 19 and 20 are formed with four slots 22, opposed in pairs with two pairs of slots on each side of the web 21, which accommodate the opposite edges of four knives 11, two on each side of the web.

The four knives 11 are retained in the knife block 12 by two knurled cylindrical clamping blocks 23, each of which is accommodated in an individual slot 24 in the member 19 with the axis of the block at right angles to the planes of the knives. Each block 23 is pressed into engagement with the edges of the four knives 11 by a cap head clamping screw 25 which are screwed into tapped holes in the front member 19. The tips of the screws 25 engage dimples 26 in the blocks 23 as shown in FIG. 4.

Since each knife block 12 carries four knives, its width in the case of a 1/16" gauge tufting machine will be ¼". The pegs 13 are therefore of sufficient diameter to withstand the stresses to which they are subjected in use and adequately robust clamping screws 25 of diameter 0.187" can be used.

What I claim as my invention and desire to secure by Letters Patent is:

1. A knife block for use in a fine gauge tufting machine and comprising front and rear members joined by a thinner central web, a peg projecting from the rear member for securing the knife block to a knife bar, four knives, which are disposed in pairs on opposite sides of the web and extend in planes parallel to the web with their edges accommodated in opposed pairs of slots in the front and rear members, two spaced, knurled cylindrical clamping blocks disposed in slots in the front member with their axes perpendicular to the planes of the knives and clamping screws, fitted into tapped holes in the front member, which press the clamping blocks into engagement with the edges of the knives.

2. A knife block according to claim 1, in which the clamping screws have tips which engage dimples in the clamping blocks.

* * * * *